US006210190B1

(12) United States Patent
Huang et al.

(10) Patent No.: US 6,210,190 B1
(45) Date of Patent: Apr. 3, 2001

(54) COMPACT FLEXIBLE BOARD CONNECTOR

(75) Inventors: Nan-Tsung Huang; Kun-Tsan Wu, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/450,528

(22) Filed: Nov. 29, 1999

(30) Foreign Application Priority Data

Sep. 9, 1999 (TW) ..... 88215421

(51) Int. Cl.[7] ..... H01R 12/28
(52) U.S. Cl. ..... 439/260; 439/495
(58) Field of Search ..... 439/259–270, 439/329, 372, 495, 67, 77

(56) References Cited

U.S. PATENT DOCUMENTS 4,420,206 * 12/1983 Martyniak ..... 439/67
4,647,131 * 3/1987 Van Woensel .
5,458,506 * 10/1995 Yamaguchi ..... 439/495
5,580,272 * 12/1996 Yamaguchi et al. ..... 439/260
5,695,360 * 12/1997 Seto et al. ..... 439/260

* cited by examiner

*Primary Examiner*—Gary F. Paumen
(74) *Attorney, Agent, or Firm*—Wei TeChung

(57) ABSTRACT

A flexible board connector comprises a dielectric housing, a plurality of terminals, and a pressure member. The housing has an elongate base, a pair of side walls upwardly depending from the base, each side wall defining an upwardly facing opening and a retaining stop, and a plurality of receiving passageways for receiving the plurality of terminals. The pressure member includes a cylindrical spindle and a pressure body which defines a central longitudinal cavity corresponding in size to the spindle. A retention ridge outwardly extends from the pressure body along the length of the pressure body. In assembly, the spindle is received in the cavity of the pressure body and both ends of the spindle are press-fitted into the openings of the housing. The retention ridge is moved to rotate the pressure body from an open position where a flexible circuit board can be inserted into the flexible board connector to a closed position where the flexible circuit board is pressed against the terminals of the flexible board connector by the pressure body. The pressure member is adapted for easy assembly and minimizes the dimensions of the flexible board connector.

1 Claim, 12 Drawing Sheets

COMPACT FLEXIBLE BOARD CONNECTOR

BACKGROUND OF THE INVENTION

1. Field of the Invention

The present invention relates to a flexible board connector, and particularly to a compact flexible board connector for retaining a flexible circuit board in electrical connection with the terminals thereof.

2. Brief Description of the Prior Art

U.S. Pat. No. 5,458,506 discloses a prior art flexible board connector (see FIG. 11) having an elongated pressure member 147 attached to a housing 160 and a plurality of contact elements 135 received in the housing 160. The pressure member 147 is adapted to rotate around a turning center 145 of a fulcrum portion 137 of the contact element 135 from a closed position to an open position. A pressure edge 152 is provided on the pressure member 147. When the pressure member 147 is in the closed position, the pressure edge 152 is inside a line including the turning center 145 and a contact portion 140 of the contact element 135 and presses a flexible circuit board F (shown in phantom) against the contact portion 140. When the pressure member 147 is in the open position, the pressure edge 152 is outside the line and the flexible circuit board F is ready to be extracted. The pressure member 147 is designed to self-retain in the closed position and to apply enough torque to constrain the flexible circuit board. The flexible board connector therefore, requires enough space for the elongated pressure member 147 to rotate therein. What is more, the length of the pressure member 147 must be long enough for operation and retention purposes. The contact elements 135 further require link portions 138 and connection portions 139 for connecting to a printed circuit board (not shown). Thus, further minimization of the width of the connector is limited.

U.S. Pat. No. 4,647,131 describes another prior art connector (see FIG. 12) with conductor retention means. The connector has a retaining element which includes a projecting part 213 and a counter element 216. The projecting part 213 defines a toothed surface 214 on a top end thereof for cooperating with a friction surface 215 on the counter element 216 to fix a flexible circuit board 210 therebetween, whereby the flexible circuit board 210 makes electrical contact with contact surfaces 225, 226 of a plurality of terminals 220. The retaining element further provides a spindle 211 coupled to a lever 217 for swiveling the projecting part 213. The spindle 211 then rotates in a clockwise direction to swivel the projection part 213 from a position of pressing against the flexible circuit board 210 to a position where the upper contact surface 225 of the terminal 220 is lifted by a protrusion surface 219 of the projecting part 213 to release the flexible circuit board 210. The toothed surface 214 must be precisely manufactured to securely press on the flexible circuit board 210 without scraping circuit traces on the flexible circuit board 210. Production cost of the connector is consequently high.

Other prior art connectors are disclosed in Taiwan Patent Application Nos. 83102251, 83112042, and 86203032.

An improved flexible board connector is required to overcome the disadvantages of the prior art.

BRIEF SUMMARY OF THE INVENTION

A first object of the present invention is to provide a compact flexible board connector;

A second object of the present invention is to provide a compact flexible board connector which is more reliable; and A third object of the present invention is to provide a compact flexible board connector which is easy to assemble.

To achieve the above objects, a compact flexible board connector of the present invention comprises a dielectric housing, a plurality of conductive terminals being received in a plurality of receiving passageways of the housing, an elongated cylindrical spindle, and a pressure body enclosing the spindle. The housing has a flat base, a pair of side walls upwardly depending from opposite ends of the base, a beam formed between the side walls and a plurality of receiving passageways defined in a bottom surface of the beam. The side walls each define an opening extending downwardly from a top edge thereof. Each of the openings is flanked by a pair of lead-ins and communicates with a receiving hole for receiving the spindle. A retaining stop is formed on an upper inside corner of each side wall and includes a wedge and a block for retaining the pressure body in a closed position.

The pressure body has an oval cross-section and defines a central longitudinal cavity for receiving the spindle. An elongate retention ridge is formed along the length of the outside of the pressure body which is used as a handle to rotate the pressure body about the spindle. The retention ridge is small but adapted for easily operating the pressure body. Furthermore, the retention ridge and the retaining stops fit in the space between the side walls so the connector size is minimized.

In assembly, the plurality of terminals is received in the receiving passageways of the housing. The spindle is inserted in the cavity of the pressure body and both ends of the spindle are received in the receiving holes of the housing. The pressure body is placed in an open position where the major axis of the cross-section of the pressure body is nearly parallel to the base. A flexible circuit board is then inserted between the terminals and the pressure body. The retention ridge is subsequently rotated until it clamps between the wedges and the blocks, whereby the pressure body is in a closed position and the major axis is then nearly perpendicular to the base. The flexible circuit board is thereby pressed against the terminals by the pressure body.

In an alternative embodiment, the spindle is integrally formed with the housing and extends between the side walls. The pressure body defines a gap through which the spindle is press-fitted into the cavity thereof. The pressure body is adapted for rotating around the spindle from an open position, where a flexible circuit board is permitted to be extracted, to a closed position, where the pressure body presses the flexible circuit board against the terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
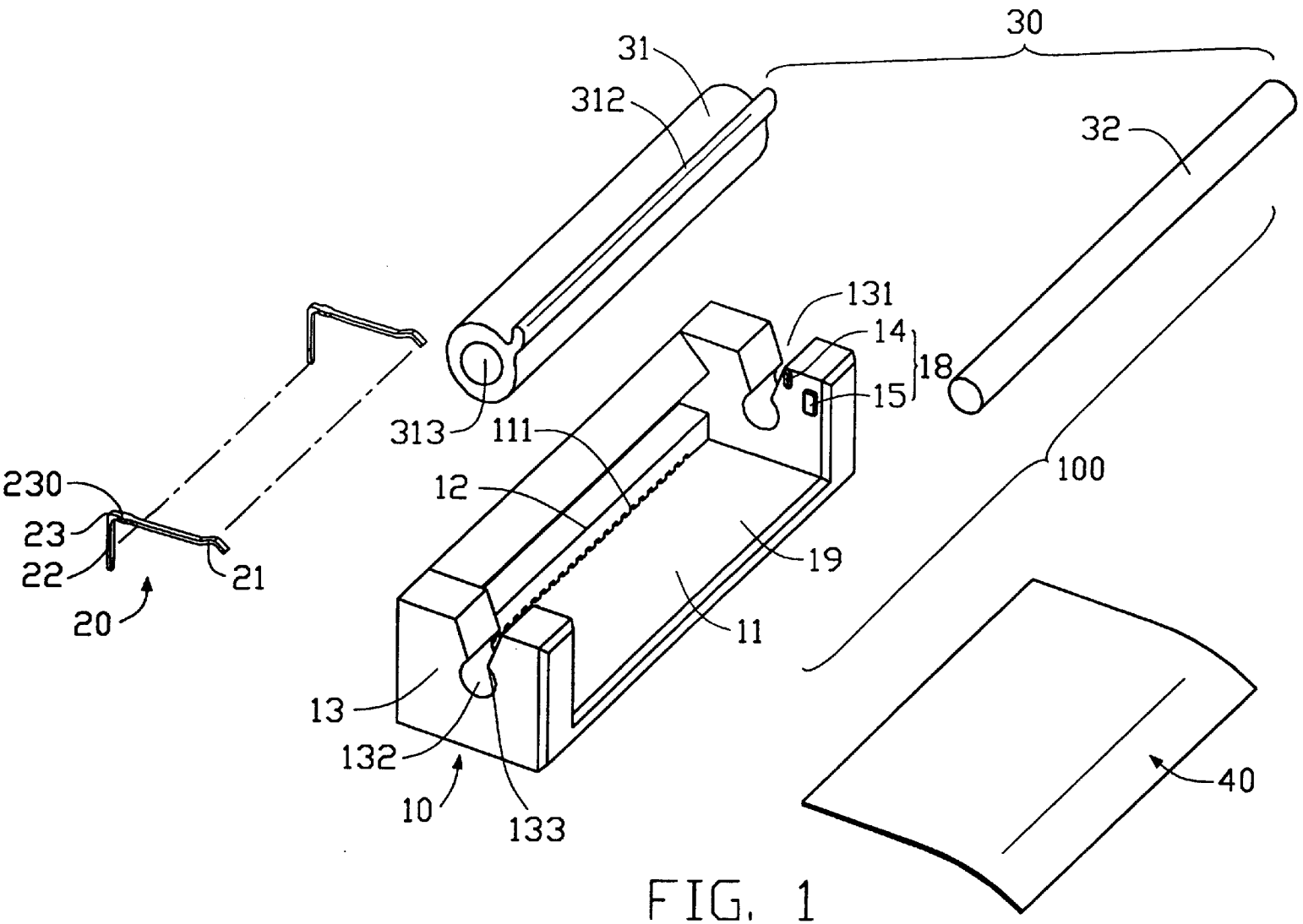
FIG. 1 is an exploded view of a flexible board electrical connector in accordance with a first embodiment of the present invention.

FIG. 1 shows a flexible circuit board 40 and a flexible board electrical connector 100 in accordance with a first embodiment of the present invention. The flexible board connector 100 comprises a dielectric housing 10, a pressure member 30 supported in the housing 10 and a plurality of conductive terminals 20 received in the housing 10.

The housing 10 includes a flat elongated base 11, a pair of side walls 13 depending upwardly from the base 11, a beam 12 extending longitudinally along the base 11 between the side walls 13, and a plurality of receiving passageways 111 defined in a bottom surface of the beam 12 adjacent the base 11. A pair of upwardly facing openings 131 are defined in top edges of the side walls 13, each opening 131 flanked by a pair of lead-ins 133 and being in communication with a receiving hole 132. The side walls 13 each form a retaining stop 18 on upper inside corners thereof. The retaining stop comprises a wedge 14 and a block 15. The side walls 13 further define a space 19 therebetween.

Each right angle terminal 20 has an engaging end 21 on one end, a soldering tail 22 on an opposite end, and a fixing portion 23 between the engaging end 21 and the soldering tail 22. Each fixing portion 23 includes a right angle bend and forms a barb 230 for interferentially securing the terminals 20 in the receiving passageways 111.

The pressure member 30 includes a cylindrical spindle 32 and an elongated tubular pressure body 31 having an oval cross-section. The pressure body 31 forms a retention ridge 312 along a length thereof for being locked between the wedges 14 and the blocks 15 of the housing 10. The pressure body 31 also defines a longitudinal central cavity 313 therein for receiving the spindle 32. The cavity 313 is of a dimension slight greater than that of the spindle 32 and allows the spindle 32 to rotate freely therein. The spindle 32 is of a diameter substantially equal to that of the receiving holes 132 for being secured in the receiving holes 132. The retention ridge 312 is small but adapted for easily operating the pressure body 31. Furthermore, the retention ridge 312 and the retaining stops 18 are accommodated in the space 19 of the housing 10 whereby the size of the connector 100 is minimized.

Figure 2:
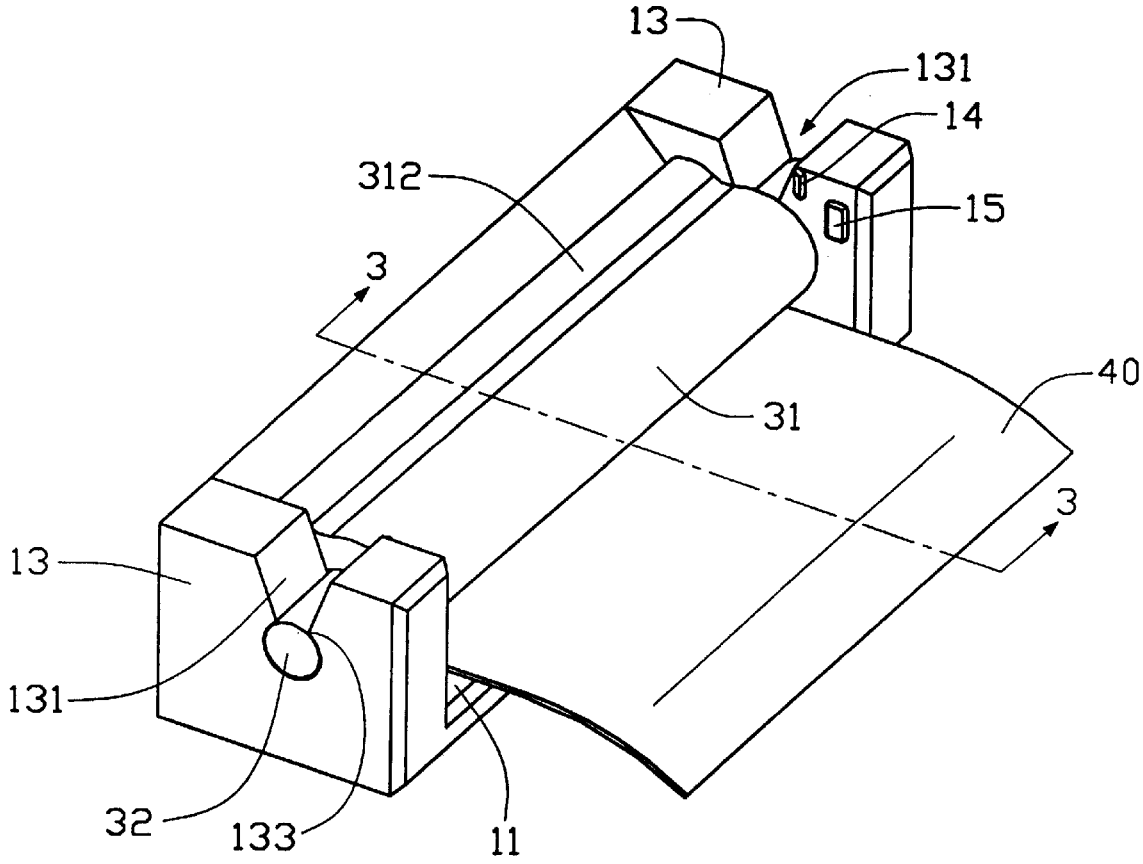
FIG. 2 is an assembled view of FIG. 1 in an open position.
Figure 3:
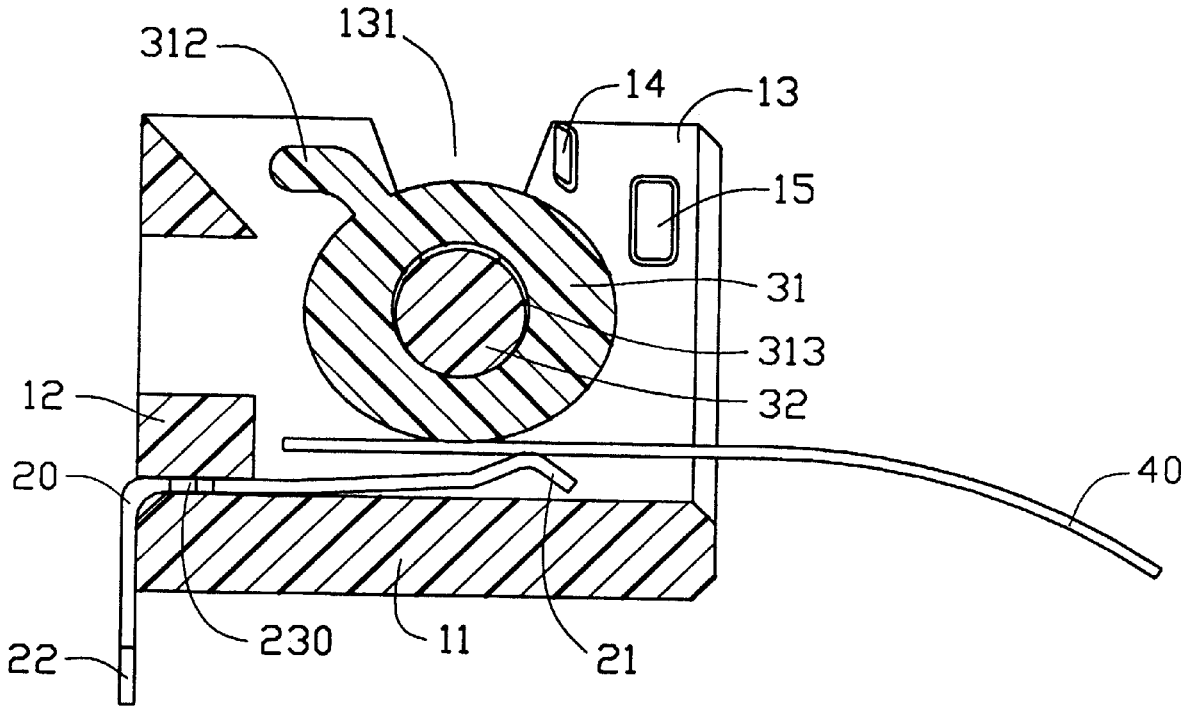
FIG. 3 is a cross sectional view of the flexible board connector of FIG. 2 taken along the line 3—3.

Also referring to FIGS. 2 and 3, in assembly, the plurality of terminals 20 is secured in the receiving passageways 111. The engaging ends 21 of the terminals 20 extend along a top surface of the base 11 for contacting an inserted flexible circuit board 40. The soldering tails 22 of the terminals 20 downwardly bend to fix into a printed circuit board (not shown). The spindle 32 is received in the cavity 313 of the pressure body 31 and is press-fitted through the lead-ins 133 into the receiving holes 132 of the housing 10. The spindle 32 is also adapted to be retracted from the receiving holes 132. The flexible circuit board 40 is then inserted between the pressure body 31 and the engaging ends 21 of the terminals 20. The pressure body 31 is initially in an open position where the major axis of the oval cross-section thereof is substantially parallel to the base 11 (see FIG. 3). The retention ridge 312 is distant from the wedges 14 and the blocks 15 and the pressure body 31 does not press against the flexible circuit board 40.

Figure 4:
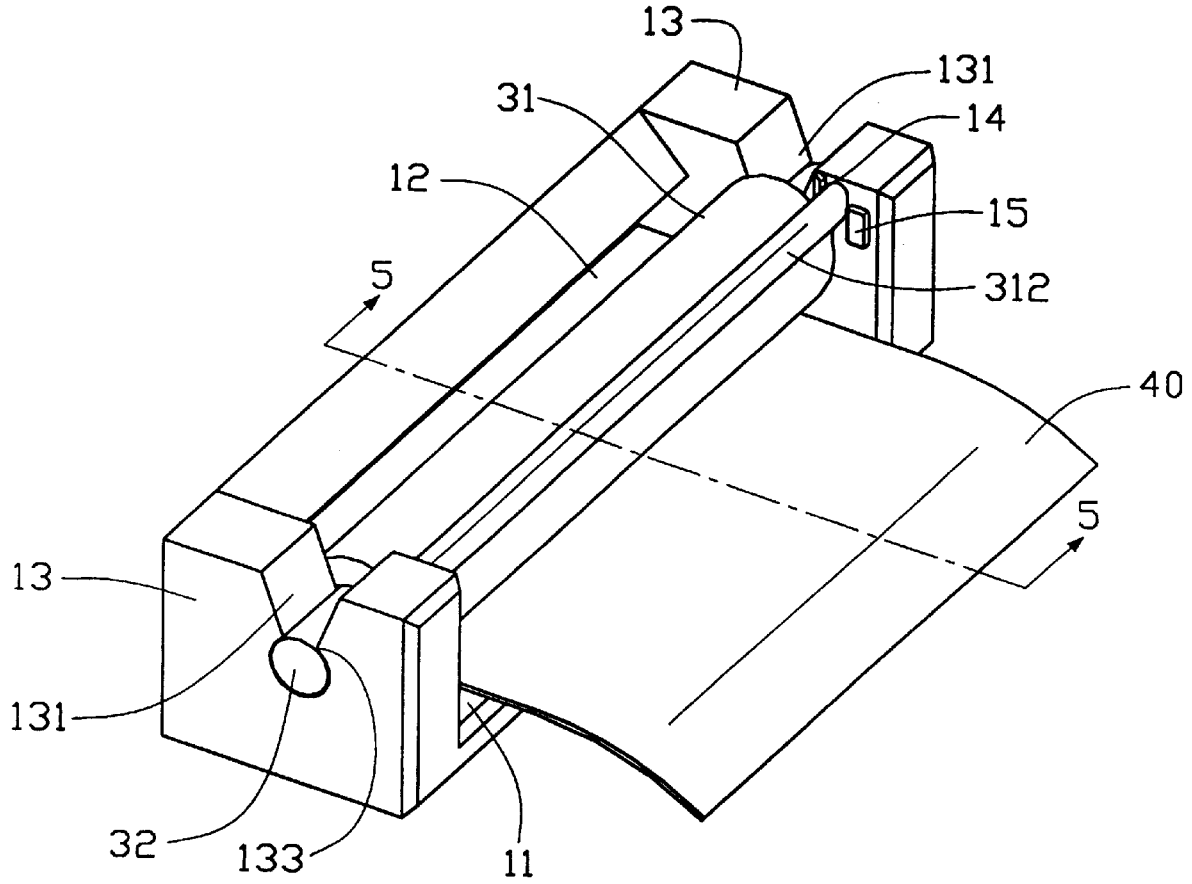
FIG. 4 is a view similar to FIG. 2, but in an closed position.
Figure 5:
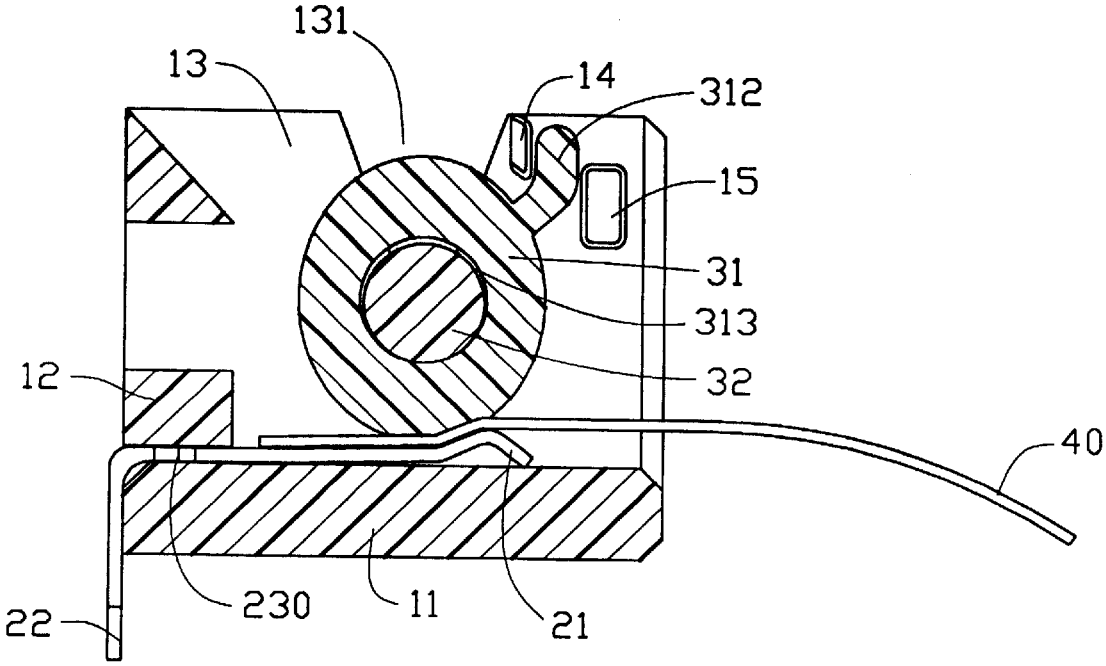
FIG. 5 is a cross sectional view of the flexible board connector of FIG. 4 taken along the line 5—5.

Referring to FIGS. 4 and 5, when the pressure body 31 pivots about the spindle 32 from the open position to a closed position, the retention ridge 312 then locks between the wedges 14 and the blocks 15 whereby the major axis of the pressure body 31 will be in a position perpendicular to the base 11. Therefore, the pressure body 31 will press against the flexible circuit board 40 securing it in position and establishing a stable electrical connection between the engaging ends 21 of the terminals 20 and the circuit traces on the flexible circuit board 40.

Figure 6:
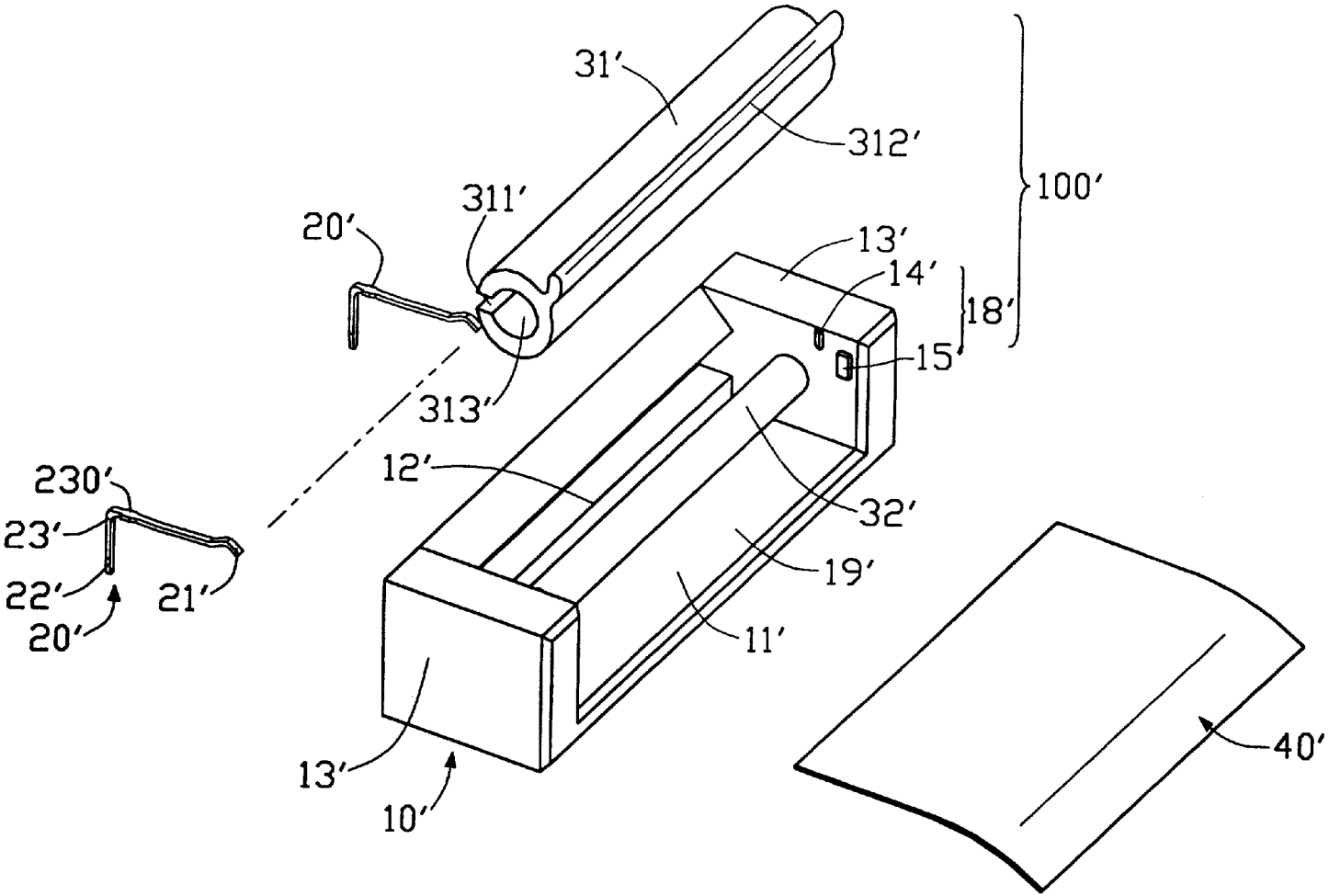
FIG. 6 is an exploded view of a flexible board electrical connector in accordance with a second embodiment of the present invention.
Figure 7:
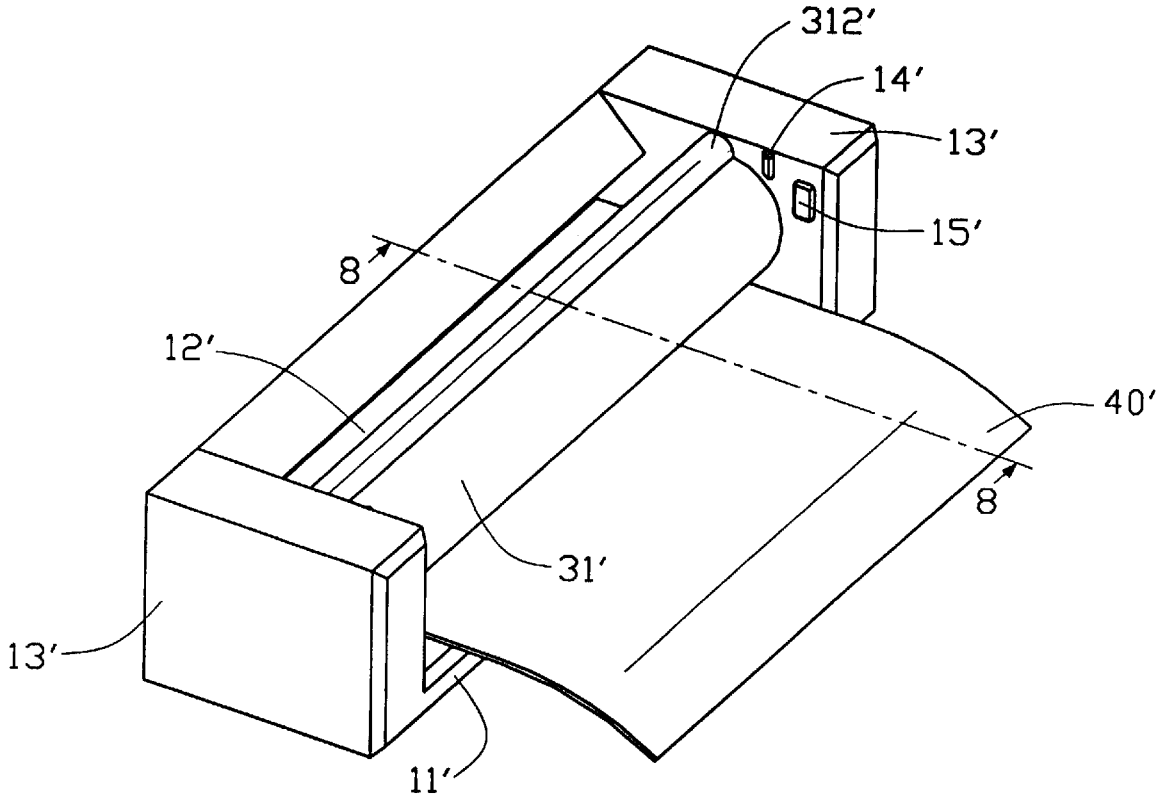
FIG. 7 is an assembled view of FIG. 6 in an open position.

FIG. 6 shows a flexible board connector 100' in accordance with a second embodiment of the present invention. The flexible board connector 100' includes an insulative housing 10', a plurality of terminals 20' each having an interfering barb 230', and a pressure body 31'.

Figure 8:
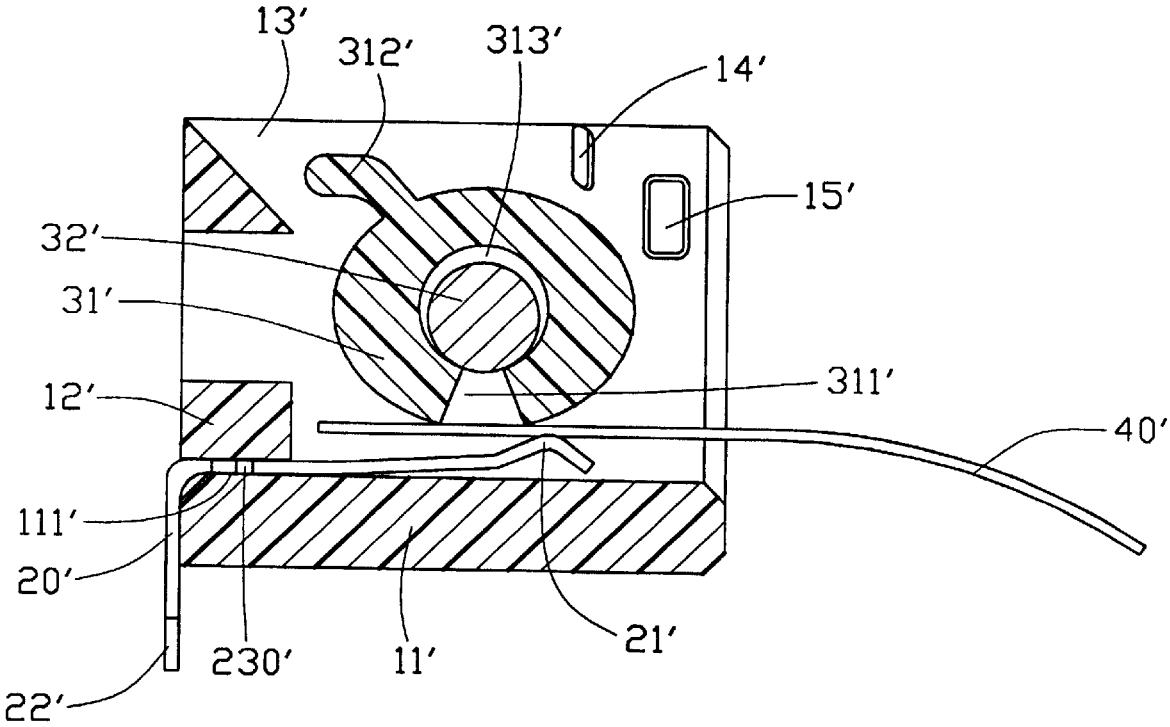
FIG. 8 is a cross sectional view of the flexible board connector of FIG. 7 taken along the line 8—8.
Figure 9:
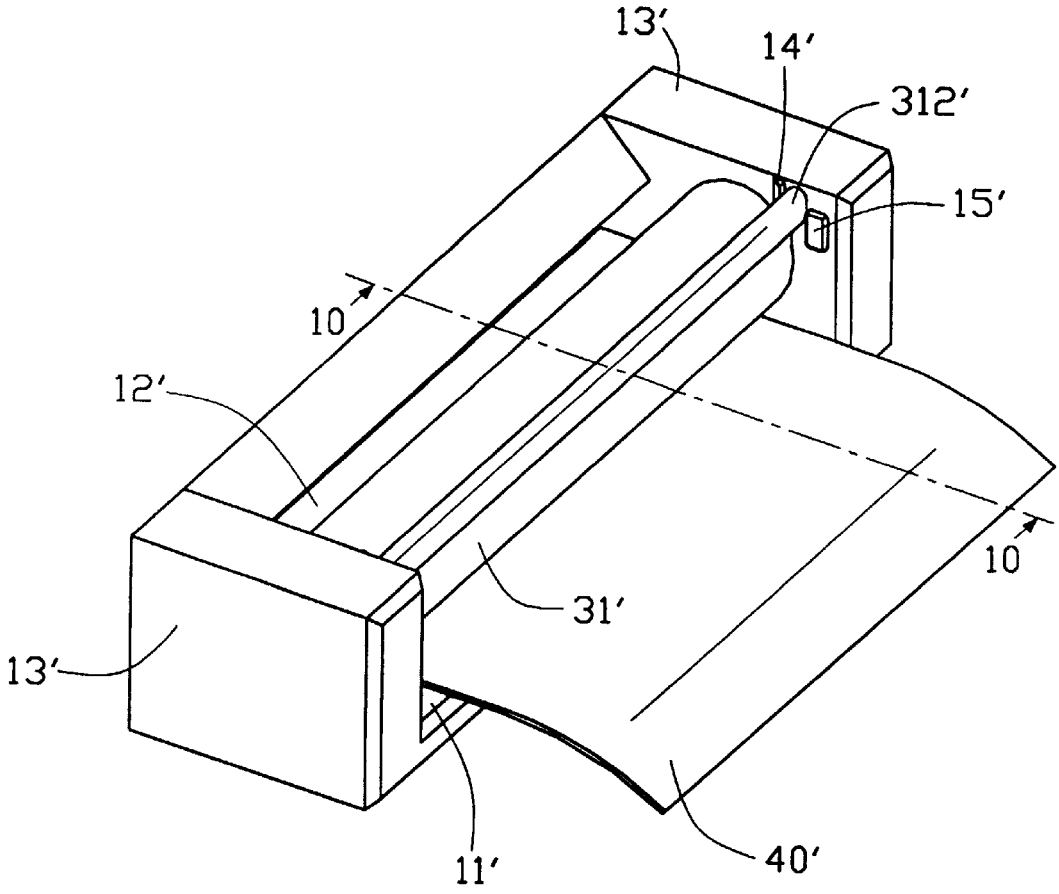
FIG. 9 is a view similar to FIG. 7, but in an closed position.
Figure 10:
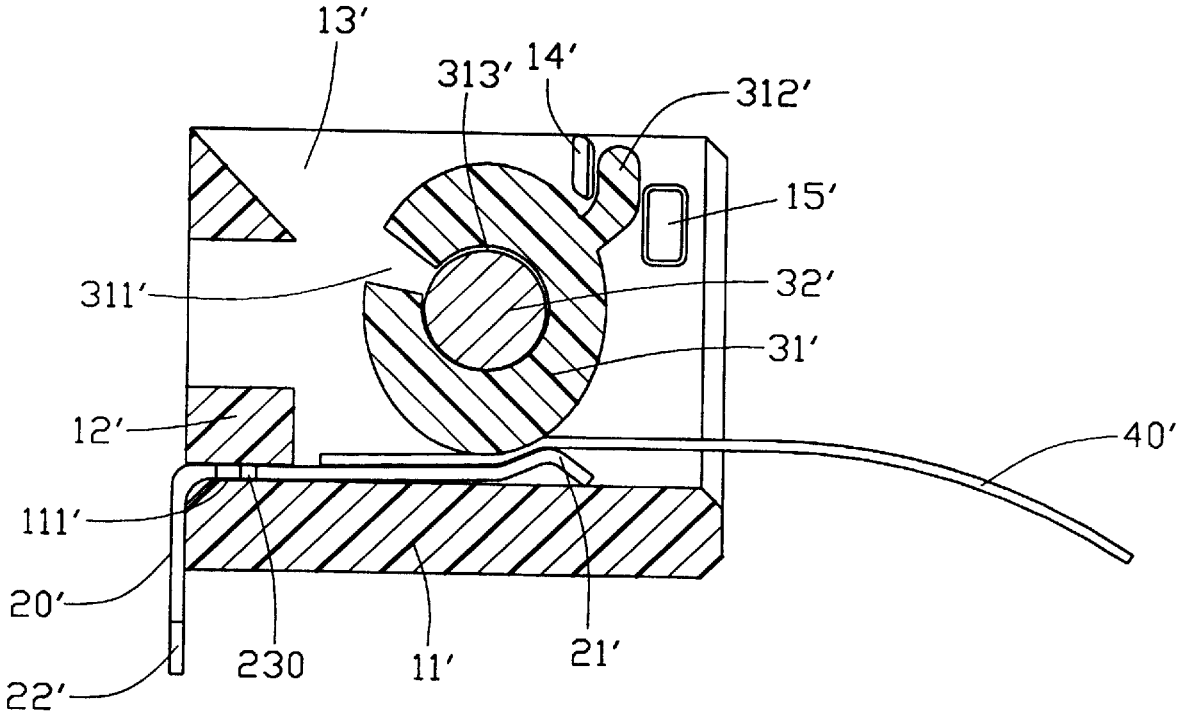
FIG. 10 is a cross sectional view of the flexible board connector of FIG. 9 taken along the line 10—10.
Figure 11:
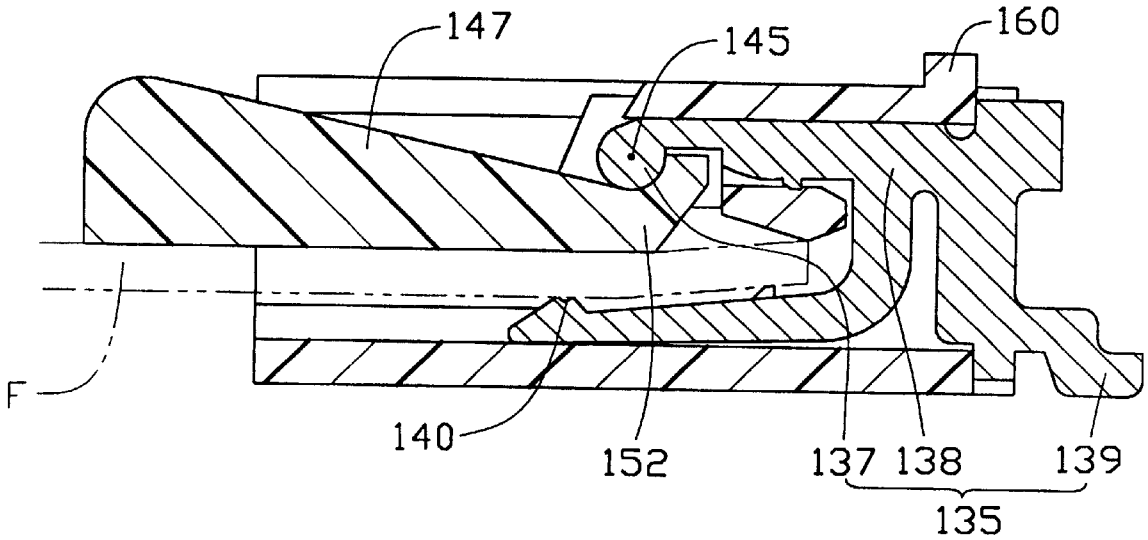
FIG. 11 (PRIOR ART)
FIG. 11 is a cross sectional view of a first prior art flexible board connector.
Figure 12:
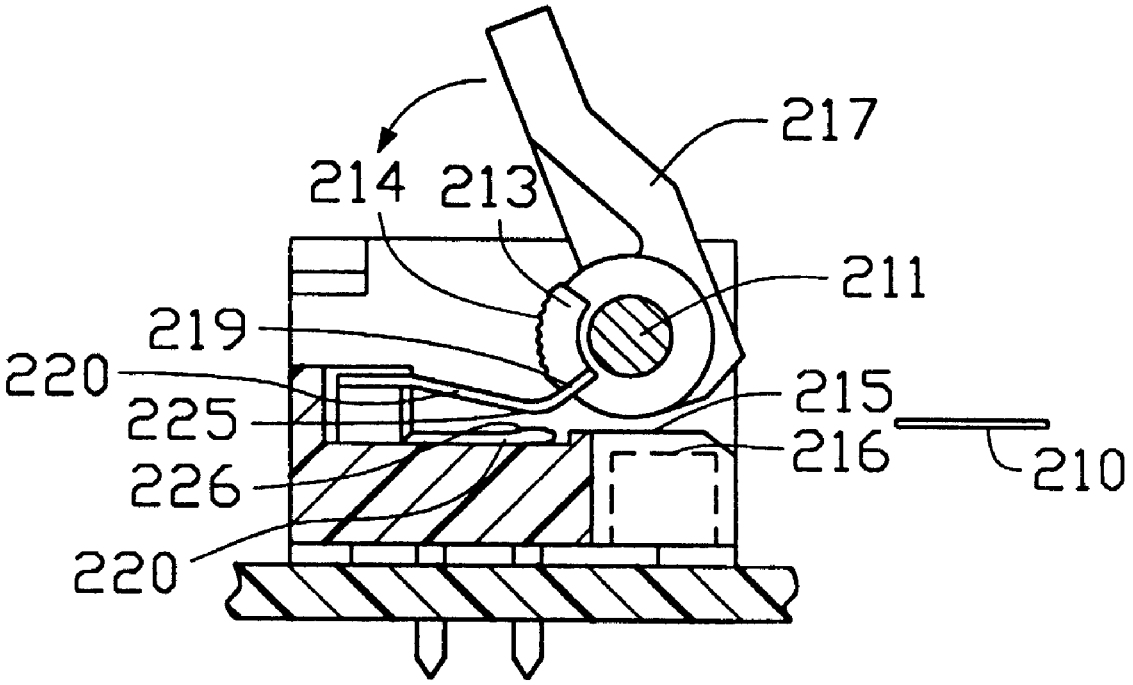
FIG. 12 (PRIOR ART)
FIG. 12 is a cross sectional view of another prior art flexible board connector.

The housing 10' has a flat base 11', a pair of side walls 13' upwardly depending from opposite ends of the base 11' and a beam 12' lying between the side walls 13' on the base 11'. The housing 10' further includes a cylindrical spindle 32' which is integrally formed with the housing 10' and extends between the side walls 13'. The beam 12' defines a plurality of receiving passageways 111' therethrough (FIGS. 8 and 10) to a rear surface thereof. Each of the side walls 13' forms a retaining stop 18' comprising a wedge 14' and a block 15'. Both wedges 14' and blocks 15' are provided on upper inside corners of the side walls 13'.

The elongated tubular pressure body 31' has an oval cross-section. The pressure body 31' defines a longitudinal central cavity 313' for receiving the spindle 32' and forms a retention ridge 312' outwardly depending therefrom. The retention ridge 312' is configured along the length of the pressure body 31' at a position between the major and minor axis of the oval cross-section of the pressure body 31'. The pressure body 31' further defines a gap 311' running the length of the pressure body 31' proximate a minor axis of the oval cross-section thereof.

Referring to FIGS. 7 to 10, in assembly, the plurality of terminals 20' is received in the receiving passageways 111', the interfering barbs 230' thereof securely engaging with the receiving passageways 111'. The engaging ends 21' of the terminals 20' extend along a top surface of the base 11' for contacting a flexible circuit board 40'. The soldering tails 22' of the terminals 20' are downwardly bent to fit into a printed circuit board (not shown). The spindle 32' is press-fitted into the cavity 313' of the pressure body 31' through the gap 311'. The pressure body 31' is adapted to be extractable from the housing 10' by disengaging the spindle 32' from the cavity 313' of the pressure body 31' through the gap 311'.

The pressure body 31' is rotatable from an open position to a closed position by using the retention ridge 312' as a handle. When the pressure body 31' is in the open position (FIG. 8) where the major axis of the oval cross-section is nearly parallel to the base 11', the retention ridge 312' is distant from the retaining stops 18' and the flexible circuit board 40' is permitted to be inserted between the pressure body 31' and the engaging ends 21' of the terminals 20'. The pressure body 31' pivots about the spindle 32' from the open position to the closed position where the major axis is nearly perpendicular to the base 11', and the retention ridge 312' is then fixed between the wedges 14' and the blocks 15' of the side walls 13'. Therefore, the pressure body 31' in the closed position (FIG. 10) presses the flexible circuit board 40' against the engaging ends 21' of the terminals 20' providing a stable electrical connection between the contacts 20' and the circuit traces on the flexible circuit board 40'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flexible board connector, comprising:

a housing including an elongated base, a pair of side walls upwardly depending from opposite ends of the base, a retaining stop on an inside surface of each side wall, and a plurality of receiving passageways;

a plurality of terminals being received in the receiving passageways of the housing;

a spindle being supported by the side walls of the housing;

an elongated pressure body defining a cylindrical central cavity extending therethrough for rotatably mounting about the spindle and having an outer surface which has a varying radius from the central axis of the cavity; and a retention ridge outwardly extending from the pressure body for being retained by the retaining stops in a position where a flexible circuit board is pressed by the pressure body against the plurality of terminals;

wherein said pressure body has a cross-section presenting an oval outer profile;

wherein said pressure body is rotatable about the spindle from a closed position where the major axis of the oval cross-section is nearly perpendicular to the base of the housing to an open position where the major axis of the oval is nearly parallel to the base of the housing;

wherein said pressure body presses a flexible circuit board against engaging ends of the terminals in the closed position, and permits the flexible circuit board to be extracted in the open position;

wherein said retention ridge extends along the length of the pressure body and is used as a handle to rotate the pressure body;

wherein said side wall defines a receiving opening, an upwardly facing opening in communication with a receiving hole, and a pair of lead-ins;

wherein said spindle is press-fitted into the receiving holes.

* * * * *